US007254359B2

(12) United States Patent
Iwakura et al.

(10) Patent No.: US 7,254,359 B2
(45) Date of Patent: Aug. 7, 2007

(54) TRANSFER APPARATUS AND IMAGE FORMING APPARATUS

(75) Inventors: Yoshie Iwakura, Higashiosaka (JP); Susumu Murakami, Souraku-gun (JP); Kuniaki Nakano, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 215 days.

(21) Appl. No.: 11/052,981

(22) Filed: Feb. 7, 2005

(65) Prior Publication Data

US 2005/0185991 A1 Aug. 25, 2005

(30) Foreign Application Priority Data

Feb. 19, 2004 (JP) ..... 2004-043342

(51) Int. Cl.
*G03G 15/01* (2006.01)

(52) U.S. Cl. ..... 399/299; 399/302; 399/308

(58) Field of Classification Search ..... 399/299, 399/301, 302, 303, 306, 308
See application file for complete search history.

(56) References Cited

U.S. PATENT DOCUMENTS 4,873,541 A 10/1989 Hirose et al.
6,934,497 B2 * 8/2005 Hagiwara et al. ..... 399/299
6,938,351 B2 * 9/2005 Kobayashi et al. ..... 33/299

FOREIGN PATENT DOCUMENTS

| | | |
|---|---|---|
| JP | 64-040847 | 2/1989 |
| JP | 2574804 | 10/1996 |
| JP | 09-022158 | 1/1997 |
| JP | 10-39651 | 2/1998 |
| JP | 10-293437 | 11/1998 |
| JP | 2002-014515 | 1/2002 |
| JP | 2003-035986 | 2/2003 |
| JP | 2003-162128 | 6/2003 |

* cited by examiner

*Primary Examiner*—Hoan Tran
(74) *Attorney, Agent, or Firm*—David G. Conlin; David A. Tucker; Edwards Angell Palmer & Dodge LLP

(57) ABSTRACT

A transfer apparatus and an image forming apparatus are disclosed, in which a plurality of photosensitive drums corresponding to the respective colors are arranged along the outer peripheral surface of a transfer belt and a plurality of intermediate transfer rollers for applying a transfer field to the photosensitive drums are arranged offset downstream side from each of the photosensitive drums, respectively. In addition to that, the process, the intermediate transfer rollers are arranged in such positions that each of the nip width are increased progressively downstream side, respectively and each of the nip pressure are decreased progressively downstream side, respectively.

20 Claims, 9 Drawing Sheets

CONTACT AREA :SMALL
COHESION :SMALL
ELECTROSTATIC TRANSFER :FACILE

CONTACT AREA :LARGE
COHESION :LARGE
ELECTROSTATIC TRANSFER :DIFFICULT

FIG. 7

| NIP WIDTH (mm) | EVALUATION OF IMAGE QUALITY | | EVALUATION OF ENDURANCE OF TRANSFER BELT | | |
|---|---|---|---|---|---|
| | TRANSFER EFFICIENCY | PRINTING DENSITY | DRIVING PERFORMANCE | WRINKLE/ CRACKING | ENDURANCE |
| 2.0 | × (82%) | × (ID: 1.34) | × | ◎ | × |
| 2.5 | △ (88%) | △ (ID: 1.37) | × | ◎ | △ |
| 3.0 | ○ (92%) | ○ (ID: 1.41) | ○ | ◎ | ○ |
| 3.5 | ○ (93%) | ○ (ID: 1.42) | ○ | ◎ | ◎ |
| 4.5 | ◎ (95%) | ◎ (ID: 1.44) | ◎ | ◎ | ◎ |
| 5.0 | ○ (91%) | ○ (ID: 1.42) | ◎ | ○ | ○ |
| 5.5 | ○ (90%) | ○ (ID: 1.40) | ◎ | △ | △ |
| 6.0 | × (85%) | × (ID: 1.30) | ◎ | × | △ |
| 7.0 | × (75%) | × (ID: 1.28) | ◎ | × | × |

NIP PRESSURE :Pd < Pc < Pb < Pa
NIP WIDTH :Wd > Wc > Wb > Wa
TRANSFER FIELD:Ed = Ec = Eb = Ea

TRANSFER APPARATUS AND IMAGE FORMING APPARATUS

CROSS-REFERENCE TO RELATED APPLICATIONS

This nonprovisional application claims priority under 35. U.S.C. §119(a) on Patent Application No. 2004-043342 filed in Japan on Feb. 19, 2004, the entire contents of which are hereby incorporated by reference.

BACKGROUND OF THE INVENTION

1. Field of the Invention

The present invention relates to a transfer apparatus and an image forming apparatus which form images by an electrophotographic method using developing agent transferred onto a transfer material (for example, a paper) with a transfer belt.

2. Description of Related Art

In recent years, demand has increased to form a full-color image as well as a monochromatic image by an image forming apparatus of electrophotographic type, and such an electrophotographic full-color image forming apparatus is under development. Normally, the full-color image forming apparatus forms images using color toner (developing agent) corresponding to each image data of a plurality of colors decomposed from a color image. For example, the same color image is read through each of the filters of each color (red, green, blue) of the three primary colors for additive color mixture, and an image data of each color (cyan, magenta, yellow) of at least the three primary colors for subtractive color mixture is created from the read data. Based on the image data of each color, a visible image is generated using toner of the corresponding color, and these visible images of the respective colors are superposed one on another thereby to form a full-color image.

In this full-color image forming apparatus, the exposure process, the development process and the transfer process are required for each color, while at the same time occurring the problem of aligning the visible images of the respective colors in position. In view of this situation, the rate at which the full-color image is formed is apparently considered lower than the rate at which the monochromatic image is formed. To overcome this problem, a full-color image forming apparatus of tandem type has conventionally been proposed in which a plurality of image forming units for forming visible images of different colors are arranged in line on the outer peripheral surface of a rotatable semiconductive endless belt along the direction of movement thereof, so that a full color image may be formed before the endless belt makes at least one rotation.

To increase the speed of forming a full-color image, the full-color image forming apparatus of tandem type employs an intermediate transfer method in which the visible images of the respective colors formed in the image forming units are superposed one on another on the outer peripheral surface of the endless belt and then transferred onto the paper, or a transfer conveyance method in which the visible images of the respective colors formed by the image forming units are transferred sequentially onto the surface of a transfer material (for example, a paper) conveyed by adsorption on the outer peripheral surface of the endless belt (for example, Japanese Patent Application Laid-Open No. 10-039651 (1998) and Japanese Patent Application Laid-Open No. 10-293437 (1998) and Japanese Patent No. 2574804).

FIG. 1 is a schematic diagram for explaining the configuration of the essential portion of the conventional full-color image forming apparatus employing the intermediate transfer method. The full-color image forming apparatus shown in FIG. 1 comprises an image forming unit 200 of electrophotographic type, in which a full-color image is formed on the paper through a primary transfer process for transferring the toner images of the respective colors in superposed relation with each other on a transfer belt 201 and a secondary transfer process for transferring onto the paper the multi-color toner image formed on the transfer belt 201 in the primary transfer process. The transfer belt 201 is configured to move along the direction of the white arrow by a transfer belt driving roller 202 and a transfer belt driven roller 203. Photosensitive drums 204*a* through 204*d* corresponding to the respective colors (for example, yellow, magenta, cyan and black) and intermediate transfer rollers 205*a* through 205*d* in opposed relation to the photosensitive drums 204*a* through 204*d*, respectively, are arranged along the path of the transfer belt 201.

In such conventional full-color image forming apparatus, consider a case in which an image is printed based on the image data inputted from the external. First, the electrically charged toner images of the respective colors are formed on the surface of the respective photosensitive drums 204*a* through 204*d*. Then, high-voltage transfer bias is applied to the intermediate transfer rollers 205*a* through 205*d*, so that the toner images on the photosensitive drums 204*a* through 204*d* are sequentially transferred onto the transfer belt 201. In the process, the transfer timing of the respective toner images is controlled, so that the toner images of the respective colors are superposed one on another and a single multi-color toner image is formed on the transfer belt 201. Then, a high voltage of opposite polarity to the charge polarity of the toner is applied to the transfer roller 206 arranged in the subsequent stage of the primary transfer process, with the result that a multi-color toner image is transferred on the paper supplied from a paper feeding unit 210. The paper onto which the multi-color toner image has been transferred is conveyed to a fixing unit-not shown, where the multi-color toner image is fixed on the paper. Thus, a printed matter formed with a full-color image is completed.

The toner image transfer efficiency of the full-color image forming apparatus of intermediate transfer type described above is determined by the toner transfer field and the adherence between the toner and the transfer belt 201. The toner transfer field is controllable by adjusting the transfer current, the transfer voltage and the transfer nip. By optimizing these parameters and thus improving the transfer efficiency, the image quality can be improved. On the other hand, the adherence between the toner and the transfer belt 201 is the intermolecular attraction (Van der Waals force) between them, and therefore dependent on the material of the transfer belt 201 and the shape of the toner on the one hand and varies with the contact area between the toner and the transfer belt 201 at the same time.

FIG. 2 is a schematic diagram showing the state of the toner attached on the transfer belt 201. In the case where the contact pressure between the photosensitive drum 204*a* and the transfer belt 201 is small, as shown in FIG. 2A, the contact area between the transfer belt 201 and the toner transferred in the primary transfer process is reduced, and so are both the intermolecular attraction between them and the cohesion between the toner. As a result, the electrostatic transfer in the secondary transfer process is facilitated, and the toner image can be satisfactorily transferred onto the paper. In the case where the contact pressure between the photosensitive drum 204*a* and the transfer belt 201 is large, on the other hand, as shown in FIG. 2B, the contact area between the toner and the transfer belt 201 is increased. Therefore, the intermolecular attraction between them and the cohesion between the toner are both increased, so that the electrostatic transfer of the toner image in the secondary transfer process becomes difficult. Especially in the full-color image forming apparatus of tandem type described above, the toner images corresponding to the respective colors are superposed sequentially on the transfer belt 201, and therefore, the cohesion between the toner is promoted with the progress of the transfer process, thereby causing the reduced transfer efficiency of toner image transfer from the transfer belt 201 onto the paper. Such reduction in transfer efficiency due to the intermolecular attraction between the toner and the transfer belt 201 cannot be easily improved by electrostatic control. It is necessary, therefore, to appropriately adjust the contact pressure between the photosensitive drums 204*a* through 204*d* and the transfer belt 201 and thereby to improve the transfer efficiency and the image quality.

When sequentially transferring the toner images of the respective colors to the transfer belt 201, the charge potential of the toner attached on the transfer belt 201 increases gradually. Therefore, the voltage applied to the intermediate transfer rollers 205*a* through 205*d* is required to be increased progressively. To differentiate the voltage applied to the intermediate transfer rollers 205*a* through 205*d*, however, a high-voltage transformer, etc. is required, thereby occurring the problem of the apparatus becoming bulky and an increased production cost.

BRIEF SUMMARY OF THE INVENTION

This invention has been achieved in view of the aforementioned situation, and an object thereof is to provide a transfer apparatus and an image forming apparatus having such a configuration that each image forming unit is pressed in contact with a transfer belt to differentiate the contact pressure between each of a plurality of image forming units for generating an image using developing agent and a transfer belt for carrying the transferred image. In this way, the cohesion of the developing agent on the transfer belt can be prevented, and therefore the image can be transferred to the transfer material (for example paper) satisfactorily.

Another object of the invention is to provide a transfer apparatus and an image forming apparatus having such a configuration that each image forming unit is pressed in contact with a transfer belt while differentiating the contact width between each of a plurality of the image forming units for generating an image using developing agent and a transfer belt for carrying the transferred image. Therefore, each color transfer operation in the primary transfer process can be performed without changing the applied voltage, thereby contributing to a reduced size and cost of the apparatus as a whole.

The transfer apparatus of the invention is a transfer apparatus which comprises a plurality of image forming units for forming an image using developing agent and a transfer belt with which the image forming units are pressed in contact, and forms on the transfer belt a single image by superposing one on another image formed in a primary transfer process by each of the image forming unit sequentially transferred to the transfer belt, and transfers the formed image onto a transfer material in a secondary transfer process, while the transfer belt is made to move in a predetermined direction, characterized in that each of the image forming unit is pressed in contact with the transfer belt under a different contact pressure between the transfer belt and each of the image forming units.

In such transfer apparatus according to the invention, the contact pressure between the transfer belt and each of a plurality of image forming units is differentiated and therefore the contact pressure between them can be appropriately adjusted, thereby making it possible to prevent the cohesion of the developing agent on the transfer belt and the increase in the contact area between the transfer belt and the developing unit.

The transfer apparatus of the invention is, in the above mentioned transfer apparatus, characterized in that each of the image forming units is pressed in contact with the transfer belt under the contact pressure progressively lower in the order of transfer of the image to the transfer belt by the image forming units.

In the transfer apparatus according to the invention, each image forming unit is pressed in contact with the transfer belt under the contact pressure decreased progressively in the order of transfer, and therefore the cohesion of the developing agent on the transfer belt and the increase in the contact area between the transfer belt and the developing unit are prevented.

The transfer apparatus of the invention is, in the above mentioned transfer apparatus, characterized in that the contact pressure is not less than 1 $g/mm^2$ but not more than 5 $g/mm^2$.

In the transfer apparatus according to the invention, the contact pressure between each image forming unit and the transfer belt is set to not less than 1 $g/mm^2$ but not more than 5 $g/mm^2$. In the standard transfer process in the image forming apparatus employing the electrophotographic method, therefore, the driving performance of the transfer belt can be sufficiently secured, while at the same time preventing the cohesion of the developing agent and the increase in the contact area between the transfer belt and the developing unit.

The transfer apparatus of the invention is a transfer apparatus which comprises a plurality of image forming units for forming an image using developing agent and a transfer belt with which the image forming units are pressed in contact, and forms on the transfer belt a single image by superposing one on another image formed in a primary transfer process by each of the image forming unit sequentially transferred to the transfer belt, and transfers the formed image onto a transfer material in a secondary transfer process, while the transfer belt is made to move in a predetermined direction, characterized in that each of the image forming unit is pressed in contact with the transfer belt with a different contact width in the predetermined direction with between the transfer belt and each of the image forming units.

In the transfer apparatus according to the invention, the contact width in a predetermined direction between the transfer belt and each image forming unit is differentiated. Therefore, the contact width between them can be adjusted appropriately, thereby making it possible to secure the required transfer field in the primary transfer process.

The transfer apparatus of the invention is, in the above mentioned transfer apparatus, characterized in that each of the image forming units is pressed in contact with the transfer belt with the contact width increased progressively in the order of transfer of the image to the transfer belt.

In the transfer apparatus according to the invention, each image forming unit is pressed in contact with the transfer belt with the contact width progressively increased in the order of image transfer. Without changing the applied voltage for each image forming unit at the time of transfer, therefore, the required transfer field can be secured.

The transfer apparatus of the invention is, in the above mentioned transfer apparatus, characterized in that the contact width is not less than 3 mm but not more than 10 mm.

In the transfer apparatus according to the invention, the contact width between each image forming unit and the transfer belt is set to not less than 3 mm but not more than 10 mm. In the standard transfer process of the image forming apparatus employing the electrophotographic method, therefore, the transfer field required for transfer can be secured while at the same time preventing the transfer belt from winding on the image forming unit.

The transfer apparatus of the invention is, in the above mentioned transfer apparatus, characterized in the primary transfer process is a process for applying a voltage to a plurality of conductive rollers pressed in contact with the transfer belt in spaced relation with the contact area between the transfer belt and each of the image forming units.

In the transfer apparatus according to the invention, a plurality of conductive rollers are pressed in contact with the transfer belt in spaced relation with the contact area between the transfer belt and each image forming unit. Therefore, only the transfer belt is interposed between the conductive rollers and the image forming units, so that the contact pressure between the transfer belt and the image forming units is reduced.

The transfer apparatus of the invention is, in the above mentioned transfer apparatus, characterized in that the voltage of the same magnitude is applied to the plurality of the conductive rollers in the primary transfer process.

In the transfer apparatus according to the invention, a voltage of the same magnitude is applied to each conductive roller. Therefore, the high-voltage transformer which otherwise would be required to obtain a transfer field required for the primary transfer process is not needed. Thus, the apparatus can be reduced in both size and production cost.

The transfer apparatus of the invention is, in the above mentioned transfer apparatus, characterized in the plurality of the conductive rollers are arranged so as to have substantially the same strength of image transfer to the transfer belt.

In the transfer apparatus according to the invention, the transfer strength of the image formed by each image forming unit is the same. Therefore, the cohesion of the developing agent and the increase in contact area are prevented, thereby preventing the resolution from decreasing and the image quality from being deteriorated.

The transfer apparatus of the invention is, in the above mentioned transfer apparatus, characterized the resistance value of the transfer belt is not less than $1\times10^{8}$ Ω but not more than $1\times10^{14}$ Ω.

In the transfer apparatus according to the invention, the transfer belt is set to an appropriate resistance value. Therefore, the transfer failure at the time of primary and secondary transfer process is prevented, thereby preventing the transfer potential from being left.

The transfer apparatus of the invention is, in the above mentioned transfer apparatus, characterized in that the developing agent is powder toner.

In the transfer apparatus according to the invention, the contact pressure between the image forming units and the transfer belt can be set to a low value. Even in the case where inexpensive powder toner is used, therefore, the toner image can be transferred satisfactorily. Also, the powder toner has a high cleaning performance, and therefore the untransferred toner on the image forming units and the transfer belt can be recovered with an inexpensive configuration.

Also, the image forming apparatus of the invention is an image forming apparatus comprising: a communication unit for receiving the image data from an external; and a transfer apparatus which comprises a plurality of image forming units for forming an image using developing agent and a transfer belt with which the image forming units are pressed in contact, and based on the image data received by the communication unit, forms on the transfer belt a single image by superposing one on another image formed in a primary transfer process by each of the image forming unit sequentially transferred to the transfer belt, and transfers the formed image onto a transfer material in a secondary transfer process, while the transfer belt is made to move in a predetermined direction, characterized in that each of the image forming unit is pressed in contact with the transfer belt under a different contact pressure between the transfer belt and each of the image forming units.

Also, the image forming apparatus of the invention is an image forming apparatus comprising: a communication unit for receiving the image data from an external; and a transfer apparatus which comprises a plurality of image forming units for forming an image using developing agent and a transfer belt with which the image forming units are pressed in contact, and based on the image data received by the communication unit, forms on the transfer belt a single image by superposing one on another image formed in a primary transfer process by each of the image forming unit sequentially transferred to the transfer belt, and transfers the formed image onto a transfer material in a secondary transfer process, while the transfer belt is made to move in a predetermined direction, characterized in that each of the image forming unit is pressed in contact with the transfer belt with a different contact width in the predetermined direction with between the transfer belt and each of the image forming units.

In the image forming apparatus according to these inventions, the image can be formed by transferring the satisfactorily transferred image onto a transfer material such as paper, and therefore the image quality is improved.

As described above, in the transfer apparatus according to this invention, the contact pressure between the transfer belt and each of a plurality of image forming units is differentiated and therefore the contact pressure between them can be appropriately adjusted, thereby making it possible to prevent the cohesion of the developing agent on the transfer belt and the increase in contact area between the transfer belt and the developing unit. As a result, the electrostatic transfer can be conducted satisfactorily in the secondary transfer process, and the decrease in resolution is prevented while at the same time improving the image quality.

As described above, in the transfer apparatus according to this invention, the image forming units are pressed in contact with the transfer belt in such a manner that the contact pressure decreases in the order of image transfer. Therefore, the cohesion of the developing agent on the transfer belt and the increase in contact area between the transfer belt and the developing unit can be prevented.

As described above, in the transfer apparatus according to this invention, the contact pressure between each image forming unit and the transfer belt is set to not less than 1 $g/mm^2$ but not more than 5 $g/mm^2$. In the standard transfer process in the image forming apparatus employing the electrophotographic method, therefore, the driving performance of the transfer belt can be sufficiently secured, while at the same time preventing the cohesion of the developing agent and the increase in contact area between the transfer belt and the developing unit.

As described above, in the transfer apparatus according to this invention, the contact width in the direction of movement of the transfer belt between the transfer belt and each image forming unit is differentiated. Therefore, the contact width between them can be adjusted appropriately, thereby making it possible to secure the required transfer field in the primary transfer process. Thus, the transfer failure at the time of primary transfer process can be prevented.

As described above, in the transfer apparatus according to this invention, each image forming unit is pressed in contact with the transfer belt with the contact width progressively increased in the order of image transfer. Without changing the applied voltage for each image forming unit at the time of transfer, therefore, the required transfer field can be secured.

As described above, in the transfer apparatus according to this invention, the contact width between each image forming unit and the transfer belt is set to not less than 3 mm but not more than 10 mm. In the standard transfer process of the image forming apparatus employing the electrophotographic method, therefore, the transfer field required for transfer can be secured while at the same time preventing the transfer belt from being wound on the image forming unit. Thus, the life time of the apparatus can be lengthened.

As described above, in the transfer apparatus according to this invention, a plurality of conductive rollers are pressed in contact with the transfer belt in spaced relation with the contact area between the transfer belt and each image forming unit. Therefore, only the transfer belt is interposed between the conductive rollers and the image forming units, so that the contact pressure between the transfer belt and the image forming units is reduced. Thus, the cohesion of the developing agent can be prevented. Also, since the contact area between the developing unit and the transfer belt is prevented from being increased, the image can be transferred satisfactorily in the secondary transfer process.

As described above, in the transfer apparatus according to this invention, the voltage of the same magnitude is applied to each conductive roller, and therefore the high-voltage transformer or the like to obtain the transfer field is not required in the primary transfer process. Thus, both the size and the production cost of the apparatus can be suppressed low.

As described above, in the transfer apparatus according to this invention, the transfer strength of the image formed by each image forming unit is the same. Therefore, the cohesion of the developing agent and the increase in contact area are prevented, thereby preventing the resolution from decreasing and the image quality from being deteriorated.

As described above, in the transfer apparatus according to this invention, the transfer belt is set to an appropriate resistance value. Therefore, the transfer failure in the primary and secondary transfer processes is prevented, thereby preventing the transfer potential from being left.

As described above, in the image forming apparatus according to this invention, the contact pressure between each image forming unit and the transfer belt can be set to a low value. Even in the case where inexpensive powder toner is used, therefore, the toner image can be transferred satisfactorily. Also, the powder toner has a high cleaning performance, and therefore the toner remaining untransferred on the image forming units and the transfer belt can be recovered with an inexpensive configuration.

As described above, in the image forming apparatus according to this invention, the image can be formed by transferring the satisfactorily transferred image onto a transfer material such as paper, and therefore the image quality is improved.

The above and further objects and features of the invention will more fully be apparent from the following detailed description with accompanying drawings.

BRIEF DESCRIPTION OF THE SEVERAL VIEWS OF THE DRAWINGS

FIG. 7 is a table showing a summarization of the evaluation of the image quality and the endurance of the transfer belt with the change in the transfer nip width of the image forming apparatus according to this invention;

DESCRIPTION OF THE PREFERRED EMBODIMENTS

This invention is explained specifically below with reference to the drawings showing preferred embodiments thereof.

Figure 1:
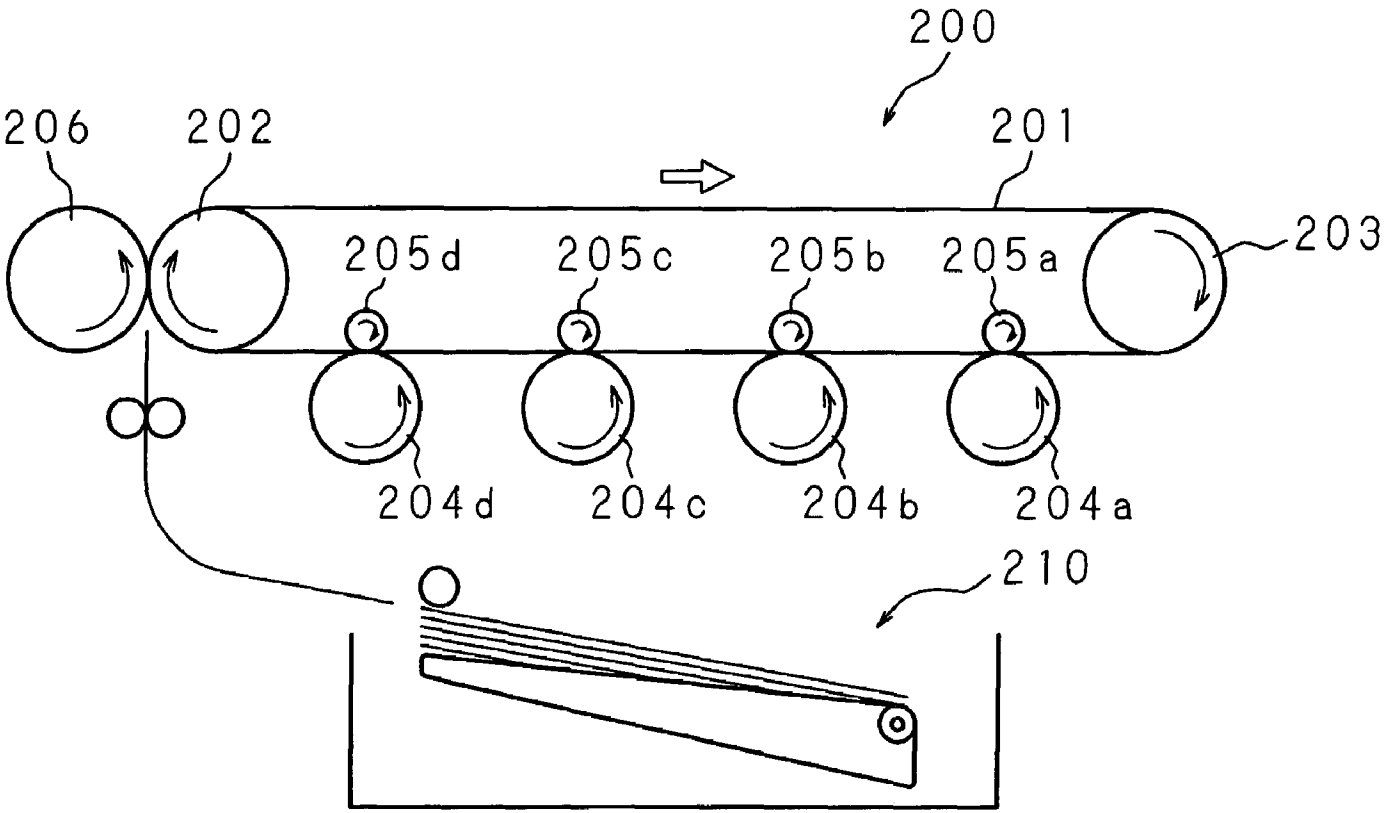
FIG. 1 PRIOR ART
FIG. 1 is a schematic diagram for explaining the configuration of the essential portion of the conventional full-color image forming apparatus employing the intermediate transfer method.
Figure 2A:
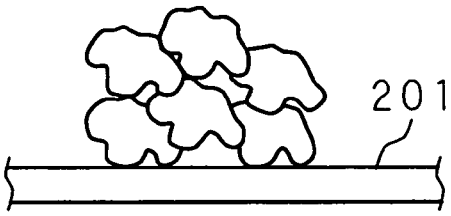
FIG. 2A PRIOR ART
FIG. 2A and FIG. 2B are schematic diagrams showing the state of the toner attached on the transfer belt.
Figure 2B:
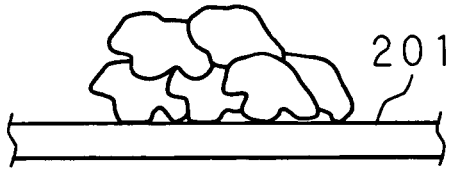
FIG. 2B PRIOR ART
Figure 3:
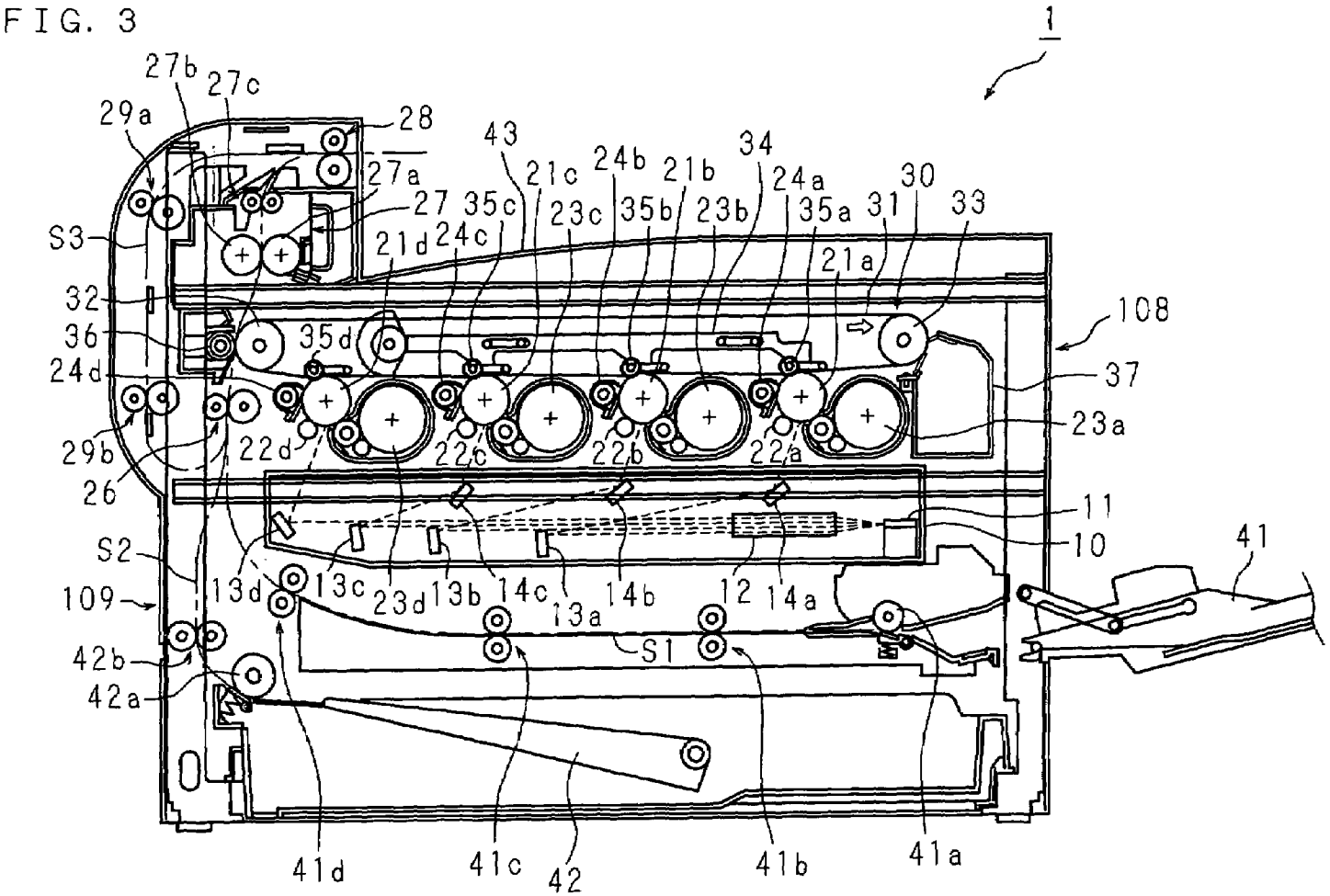
FIG. 3 is a schematic sectional view showing a general configuration of the image forming apparatus according to this invention.

FIG. 3 is a schematic sectional view showing a general configuration of the image forming apparatus according to this invention. In FIG. 3, reference numeral 1 designates an image forming apparatus according to the invention, or specifically, a digital color printer. The image forming apparatus 1 roughly comprises an image forming unit 108 and a paper feeding unit 109, wherein a multi-color image or a monochromatic image is formed on a paper (transfer material) based on the printing job data received from an information processing apparatus such as a personal computer (not shown) externally connected through a communication unit not shown.

The image forming apparatus 1 according to this invention comprises the image forming unit 108 of electrophotographic type. The image forming unit 108, to form a multi-color image using the colors of yellow (Y), magenta (M), cyan (C) and black (K), is configured of photosensitive drums 21*a*, 21*b*, 21*c*, 21*d*, chargers 22*a*, 22*b*, 22*c*, 22*d*, developing units 23*a*, 23*b*, 23*c*, 23*d* and cleaner units 24*a*, 24*b*, 24*c*, 24*d* for the respective colors, and an exposure unit 10 for forming an electrostatic latent image on the photosensitive drums 21*a*, 21*b*, 21*c*, 21*d* by emitting a laser beam based on the image data for printing.

The symbols a, b, c and d attached to the reference numerals correspond to the colors of yellow (Y), magenta (M), cyan (C) and black (K), respectively. Except in the case where a component corresponding to a specific color is designated and described, however, the components for each color are collectively referred to as photosensitive drum 21, a charger 22, a developing unit 23 and a cleaner unit 24.

The exposure unit 10 is configured of a laser scan unit (LSU) having a laser radiating unit 11. A polygon mirror 12 and reflection mirrors 13*a* through 13*d*, 14*a* through 14*c* are arranged to irradiate the photosensitive drum 21 with the laser beam emitted from the laser radiating unit 11. In place of the laser radiating unit 11, a write head including an array of light-emitting elements such as LED (light emitting diode) or EL (electro luminescence) may be used with equal effect.

The charger 22 is a roller type charger configured to contact the photosensitive drum 21 and uniformly charge the surface of the photosensitive drum 21 to a predetermined uniform potential. In place of the roller-type charger, a brush-type charger or charger-type charger may be used. The developing units 23*a* through 23*d* have stored therein the toner (developing agent) of yellow, magenta, cyan and black, respectively. The toner of each is supplied to the electrostatic latent image formed on the surface of the photosensitive drums 21*a* through 21*d* thereby to make a visible image from the toner image. The cleaner unit 24 recovers and remove the toner remaining on the surface of the photosensitive drum 21 after image transfer.

Also, the image forming apparatus 1 according to the invention is so configured that the toner image on the photosensitive drum 21 is transferred by the intermediate transfer method onto the paper supplied from the paper feeding unit 109. A transfer belt unit 30 providing a transfer apparatus according to the invention is arranged above the photosensitive drum 21. The transfer belt unit 30 includes a transfer belt 31, a transfer belt driving roller 32, a transfer belt driven roller 33, a transfer belt tension mechanism 34, and intermediate transfers rollers 35*a*, 35*b*, 35*c*, 35*d*. In the description that follows, the intermediate transfer rollers 35*a*, 35*b*, 35*c*, 35*d* are collectively referred to as the intermediate transfer roller 35.

The transfer belt driving roller 32, the transfer belt driven roller 33, the transfer belt tension mechanism 34, the intermediate transfer roller 35, etc. tension the transfer belt 31 on the one hand and rotate the transfer belt 31 in the direction of white arrow (in the direction of auxiliary scanning) in the drawing by the driving force of the transfer belt driving roller 32 on the other hand. The transfer belt 31 is formed in endless form using a film about 75 μm to 120 μm thick, and the surface thereof is in contact with the photosensitive drum 21. The toner images of the respective colors formed on the photosensitive drum 21 are transferred sequentially in superposed relation on the transfer belt 31, and thus a color toner image (multi-color toner image) is formed on the transfer belt 31. The transfer of the toner image from the photosensitive drum 21 to the transfer belt 31 is conducted by the intermediate transfer roller 35 in contact with the reverse side of the transfer belt 31. The intermediate transfer roller 35 is impressed with a high-voltage transfer bias for transferring the toner image, i.e. a high voltage of opposite polarity (+) to the charge polarity (−) of the toner. The intermediate transfer roller 35 has, as a base, a metal (stainless steel, for example) shaft 8 to 10 mm in diameter and has the surface thereof covered with a conductive elastic material such as foamed urethane or EPDM. Through this elastic material having conductivity, a high voltage is applied uniformly to the transfer belt 31 from the intermediate transfer rollers 35*a*, 35*b*, 35*c*, 35*d*.

As described above, the electrostatic image converted into a visible image corresponding to each color on the photosensitive drum 21 is superposed on the transfer belt 31, and an image for printing is reproduced on the transfer belt 31 as a multi-color toner image. The multi-color toner image transferred onto the transfer belt 31 in this way is transferred, by the rotation of the transfer belt 31, onto the paper by the transfer roller 36 arranged at a position where the paper is in contact with the transfer belt 31. In the process, the transfer belt 31 and the transfer roller 36 are pressed in contact with a predetermined nip, and at the same time, the transfer roller 36 is impressed with a voltage, i.e. a high voltage of opposite polarity (+) to the toner charge polarity (−) for transferring the multi-color image on the paper. In order to secure the nip steadily between the transfer belt 31 and the transfer roller 36, one of the transfer belt driving roller 32 and the transfer roller 36 is formed of a hard material such as metal, while the other roller is formed of a soft material such as elastic rubber or foamed resin.

The toner attached on the transfer belt 31 by contacting the photosensitive drum 21 or the toner remaining on the transfer belt 31 without transfer to the paper by the transfer roller 36 causes the color mixture of the toner in the next process, and therefore removed and recovered by the transfer belt cleaning unit 37 arranged in the vicinity of the transfer belt driven roller 33. The transfer belt cleaning unit 37 includes a cleaning blade (not shown) arranged in contact with the transfer belt 31.

The paper feeding unit 109 includes a manual tray 41 and a paper feed cassette 42 for containing the paper used for forming an image. The manual tray 41 is arranged externally to the housing of the image forming apparatus 1. Only a few number of sheets of paper of the type desired by the user are placed on the manual tray and adapted to take into the image forming apparatus 1. The paper feed cassette 42, on the other hand, is arranged under the image forming unit 108 and the exposure unit 10 to contain a great amount of paper of the size specified by the apparatus or predetermined by the user. The sheets of paper placed on the manual tray 41 are taken into the apparatus by the pickup roller 41*a* at a timing designated by the operating panel (not shown) of the image forming apparatus 1, and conveyed to the image forming unit 108 by the conveyor rollers 41*b*, 41*c* 41*d* arranged along the paper conveyance path S1. Also, the papers contained in the paper feed cassette 42 are fed one by one by the pickup roller 42*a* and conveyed to the image forming unit 108 through the conveyor roller 42*b* arranged along the paper conveyance path S2.

A register roller 26 is arranged under the transfer roller 36 and the transfer belt driving roller 32. The register roller 26 conveys the paper to the transfer roller 36 at a timing when the forward end of the paper conveyed from the paper feeding unit 109 comes into registry with the forward end of the toner image on the transfer belt 31, thereby transferring the toner image from the transfer belt 31 onto the paper.

The paper to which the toner image is transferred is conveyed substantially vertically and reaches a fixing unit 27 arranged above the transfer roller 36. The fixing unit 27 includes a heating roller 27*a* and a pressure roller 27*b*. By controlling the heating means such as a heater lamp based on the detection value of a temperature sensor not shown, the heating roller 27*a* is maintained at a predetermined fixing temperature. At the same time, the paper to which the toner image has been transferred is rotated while being held between the heating roller 27*a* and the pressure roller 27*b*. In this way, the toner image is thermally fixed on the paper by the heat of the heating roller 27*a*. The thermally fixed paper is delivered by the conveyor roller 27*c* arranged in the neighborhood of the outlet of the fixing unit 27.

The paper that has passed through the fixing unit 27, when one-side printing is required, is delivered face down on a discharge tray 43 through a discharge roller 28. In the case where the two-side printing is required, on the other hand, the paper is chucked by the discharge roller 28, led to the two-side paper conveyance path S3 by reverse rotation of the discharge roller 28, and conveyed to the register roller 26 again by the conveyor rolls 29*a*, 29*b*. After the toner image is transferred to and thermally fixed on the reverse side of the paper, the paper is delivered onto the discharge tray 43 by the discharge roller 28.

Figure 4:
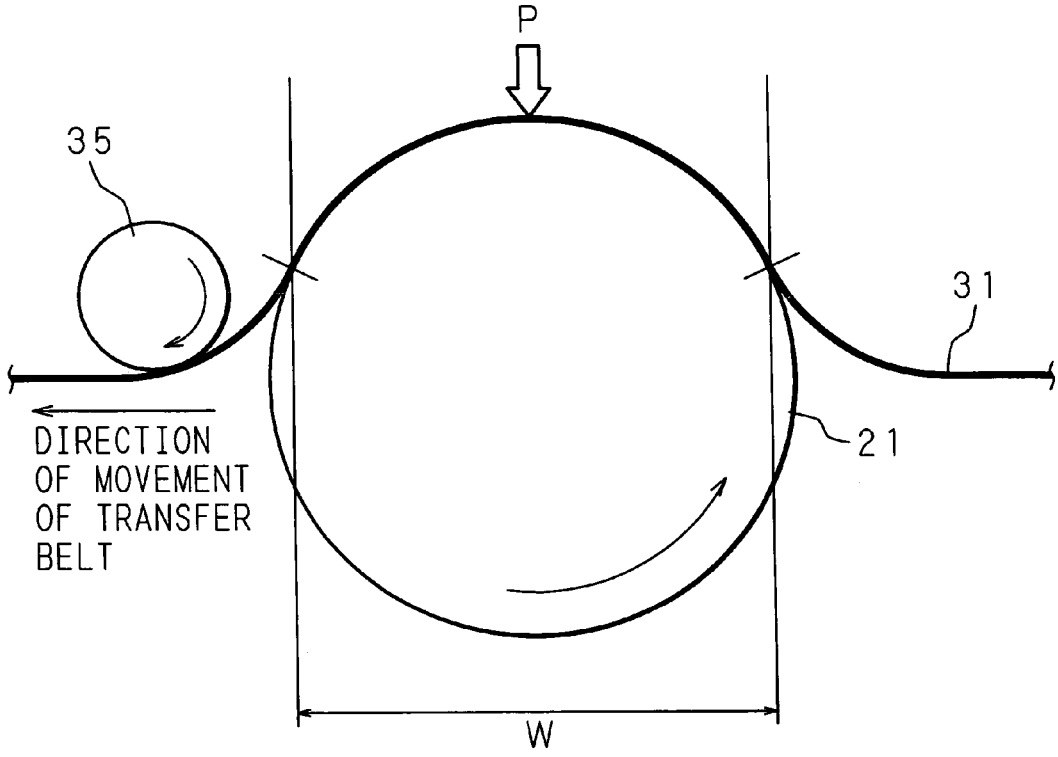
FIG. 4 is an enlarged schematic diagram showing the neighborhood of each photosensitive drum of the image forming apparatus according to this invention.

The configuration of the essential portion in the neighborhood of the photosensitive drum 21 is explained bellow. FIG. 4 is an enlarged schematic diagram showing the neighborhood of the photosensitive drum 21. The photosensitive drum 21 is arranged along the outer peripheral surface of the transfer belt 31, and rotatably supported by a shaft while pressing the transfer belt 31 upward. The intermediate transfer roller 35 is arranged along the inner peripheral surface of the transfer belt 31, and rotatably supported by a shaft while pressing the transfer belt 31 downward. The photosensitive drum 21 and the intermediate transfer roller 35 are both rotated in the forward direction of movement of the transfer belt 31 and have the respective rotational shafts in parallel with each other. The image forming apparatus 1 according to this invention has the feature that the rotational shaft of the intermediate transfer roller 35 is offset from the rotational shaft of the photosensitive drum 21 in the direction of movement of the transfer belt 31. As a result, the photosensitive drum 21 and the intermediate transfer roller 35 have no common contact area with the transfer belt 31, and only an area exists between them where only the transfer belt 31 is interposed. For this reason, in the primary transfer process of the image forming apparatus 1 according to the invention, the transfer is made possible while controlling the contact pressure at low level between the photosensitive drum 21 and the transfer belt 31. Therefore, the cohesion of the toner onto the transfer belt 31 is prevented, and an image is satisfactorily formed in the secondary transfer process.

The transfer nip in the primary transfer process is an area where the photosensitive drum 21 and the transfer belt 31 are in physical contact with each other. As parameters characterizing the transfer nip, a nip width W and a nip pressure P are introduced hereinafter. The nip width W is defined as a width along the direction of movement of the transfer belt 31 in the area where the photosensitive drum 21 and the transfer belt 31 are in physical contact with each other. The nip pressure P is defined as a pressure received by the photosensitive drum 21 from the transfer belt 31. The nip width W and the nip pressure P vary with the material of the transfer belt 31 and the arrangement of the photosensitive drum 21 and the intermediate transfer roller 35 with respect to the transfer belt 31.

Figure 5:
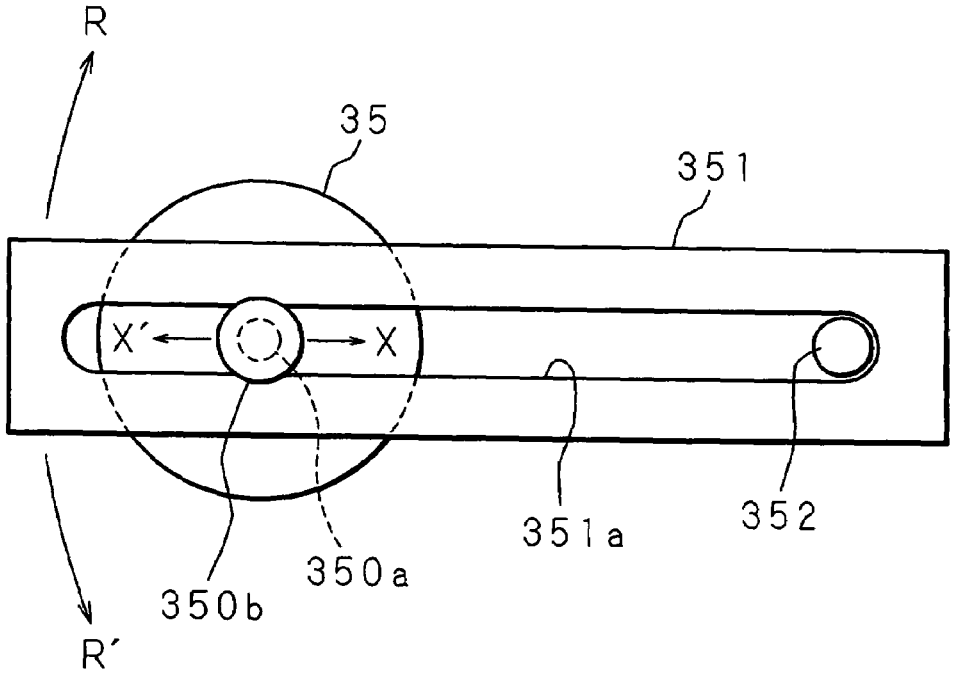
FIG. 5 is a schematic diagram showing the position adjusting mechanism for changing the arrangement of the intermediate transfer rollers of the image forming apparatus according to this invention.

This embodiment is so configured that the size of the nip width W and the magnitude of the nip pressure P are changed by changing the arrangement of the intermediate transfer roller 35 with respect to the photosensitive drum 21. This configuration is intended to optimize the quality of the image formed on the paper and to improve the endurance of the transfer belt 31. FIG. 5 is a schematic diagram showing a position adjusting mechanism for changing the arrangement of the intermediate transfer roller 35. FIG. 6 is a schematic diagram showing the state in which the nip width W changes with the arrangement of the intermediate transfer roller 35.

The intermediate transfer roller 35 is supported by a plate 351 rotatable around the rotational shaft 352 parallel to the rotational shaft 350*a* of the intermediate transfer roller 35. The vertical position of the intermediate transfer roller 35 can be changed by rotating the plate 351 in the direction R-R' in FIG. 5 around the rotational shaft 352. The plate 351 is formed with a slot 351*a* in the direction along the transfer belt 31. The rotational shaft 350*a* of the intermediate transfer roller 35 is inserted through the slot 351*a*, and fixed by an adjust knob 350*b* on the outside of the plate 351. Thus, the horizontal position of the intermediate transfer roller 35 can be changed within the range of the slot 351*a* by rotating the adjust knob 350*a* in the direction X-X' and fixing it.

Figure 6A:
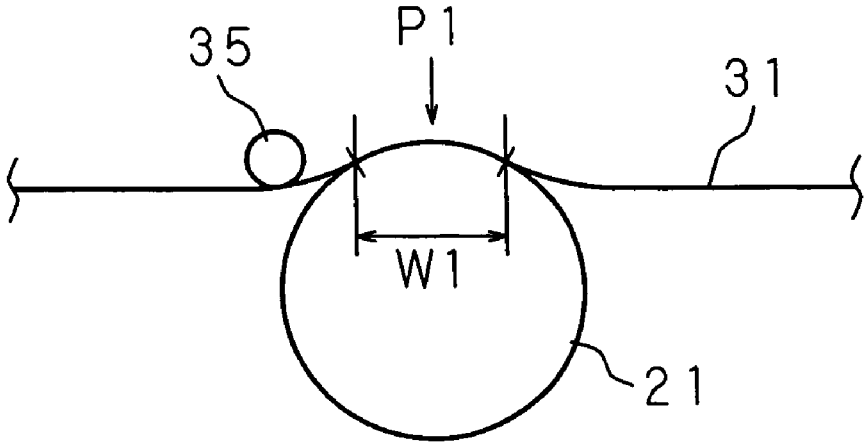
FIG. 6A and FIG. 6B are schematic diagrams showing he manner in which the nip width changes with the arrangement of the intermediate transfer rollers of the image forming apparatus according to this invention.
Figure 6B:
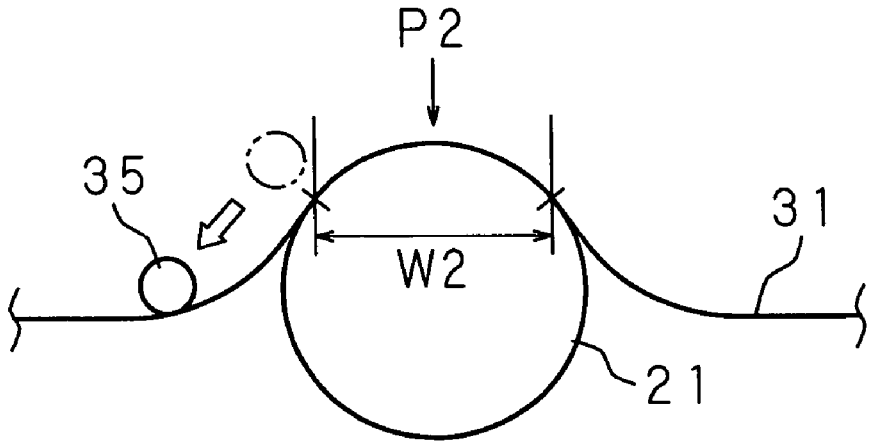

By changing the vertical position of the intermediate transfer roller 35, the size of the nip width W can be mainly changed. By changing the horizontal position of the intermediate transfer roller 35, on the other hand, the magnitude of the nip pressure P can be mainly changed. In the case where the intermediate transfer roller 35 is located at a position higher than the center of rotation of the photosensitive drum 21 and the horizontal distance from the photosensitive drum 21 is relatively short, as shown in FIG. 6A, for example, the nip width W1 is comparatively small while the nip pressure P1 is comparatively high. In the case where the intermediate transfer roller 35 is located at a position lower than the center of rotation of the photosensitive drum 21 and the horizontal distance from the photosensitive drum 21 is relatively long as shown in FIG. 6B, on the contrary, the nip width W2 is comparatively large while the nip pressure P2 is comparatively low.

The result of study conducted by the present inventors concerning the image quality evaluation and the endurance evaluation of the transfer belt 31 is explained below. FIG. 7 is a table summarizing the evaluation of the image quality and the endurance of the transfer belt 31 for different transfer nip width. These evaluation results are based on various measurements including the diameter of the photosensitive drum 21 which is 30 mm, the diameter of the intermediate transfer roller 35 which is 9 mm, the horizontal distance between the center of rotation of the photosensitive drum 21 and the center of rotation of the intermediate transfer roller 35 which is 9.0 mm, the vertical distance of the same which is 23.0 mm, and the horizontal distance between the adjoining two intermediate transfer rollers 35, 35 which is 94.2 mm. The image quality was evaluated by measuring the transfer efficiency in the primary transfer process and the printing density on the paper. The transfer efficiency is the ratio of the toner amount transferred from the surface of the photosensitive drum 21 to the transfer belt 31 in the primary transfer process, and calculated on the assumption that the toner amount existing on the photosensitive drum 21 before transfer is 100%. The printing density, on the other hand, is evaluated by measuring the black density on the paper using Macbeth density meter after the black toner transferred on the paper is fixed by the fixing unit 27. Generally, the black density is considered ID=1.40 or more. Also, the endurance of the transfer belt. 31 was evaluated relatively by evaluating the driving performance based on the observation of the snaking of the transfer belt 31 on the one hand and the observation of the wrinkle and cracking on the transfer belt 31 on the other hand.

The result of this study shows that both the image quality and the endurance of the transfer belt 31 are considerably satisfactory for the nip width of 3.0 mm or more but 5.5 mm or less, and optimum for the nip width of 4.5 mm.

The result of study conducted above also shows that as far as individual photosensitive drums 21*a* through 21*d* are concerned, a satisfactory image quality is obtained and the deterioration of the endurance of the transfer belt 31 is suppressed by setting the nip width in the above-described range. In the image forming apparatus 1 according to the invention, however, the photosensitive drums 21*a* through 21*d* are arranged in tandem and therefore the toner of the respective colors are sequentially superposed in the primary transfer process. With the progress of the primary transfer process, therefore, the thickness of the toner layer on the transfer belt 31 increases to such an extent that a required and sufficient transfer field may not be obtained even in the case where the same voltage is applied to the intermediate transfer rollers 35*a* through 35*d*. It is thus necessary to set the nip width properly to secure a required and sufficient transfer field also downstream side of the primary transfer process. The size of the nip width required to secure a required and sufficient transfer field is studied below.

Figure 8:
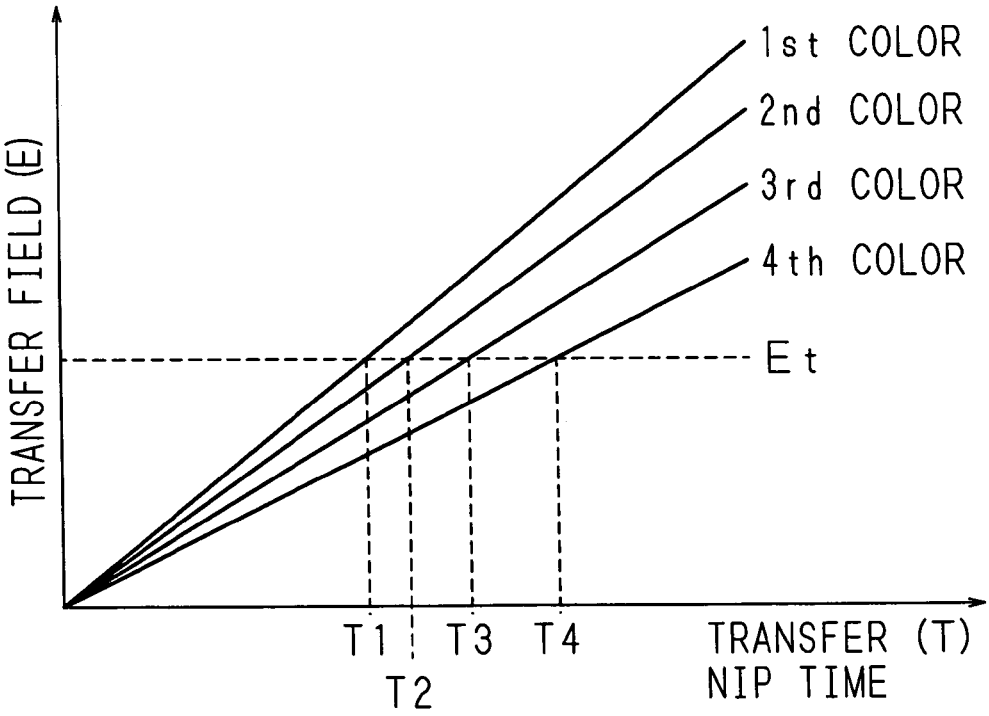
FIG. 8 is a graph showing the relation between the transfer nip time and the transfer field of the image forming apparatus according to this invention.

FIG. 8 is a graph showing the relation between the transfer nip time and the transfer field. The abscissa represents the transfer nip time T and the ordinate the transfer field E. The relation between the transfer field E and the transfer nip time T is expressed by a straight line having a predetermined gradient. As shown in the graph of FIG. 8, the transfer field Et required to transfer the toner of the first color (yellow in this embodiment) is obtained by setting the transfer nip time to T1. Also, in the case where the toner of the second color (magenta in this embodiment) is transferred, the magnitude of the voltages applied to the intermediate transfer rollers 35*a* through 35*d* are the same. Since the thickness of the toner layer on the transfer belt 31 becomes thicker than for the first color, however, the field applied into the toner layer is smaller for a smaller gradient of the straight line on the graph. As far as the second color is concerned, therefore, it is understood that the transfer nip time for obtaining the transfer field Et is not sufficiently set to the same time T1 as for the first color, but required to be set to T2 longer than T1. This is also the same for the third color (cyan) and the fourth color (black). Thus, in order to secure the minimum required transfer field Et, the transfer nip times for the third color (cyan) and the fourth color (black) are required to be set to T3, T4 (T4>T3>T2>T1) in each transfer process, respectively.

In order to obtain the required minimum transfer field Et for each color as mentioned above, it is understood that the transfer nip time T is required to be longer downstream side. In view of the fact that the transfer nip time T is proportional to the nip width W, however, the nip width W can be progressively increased as an alternative.

Figure 9:
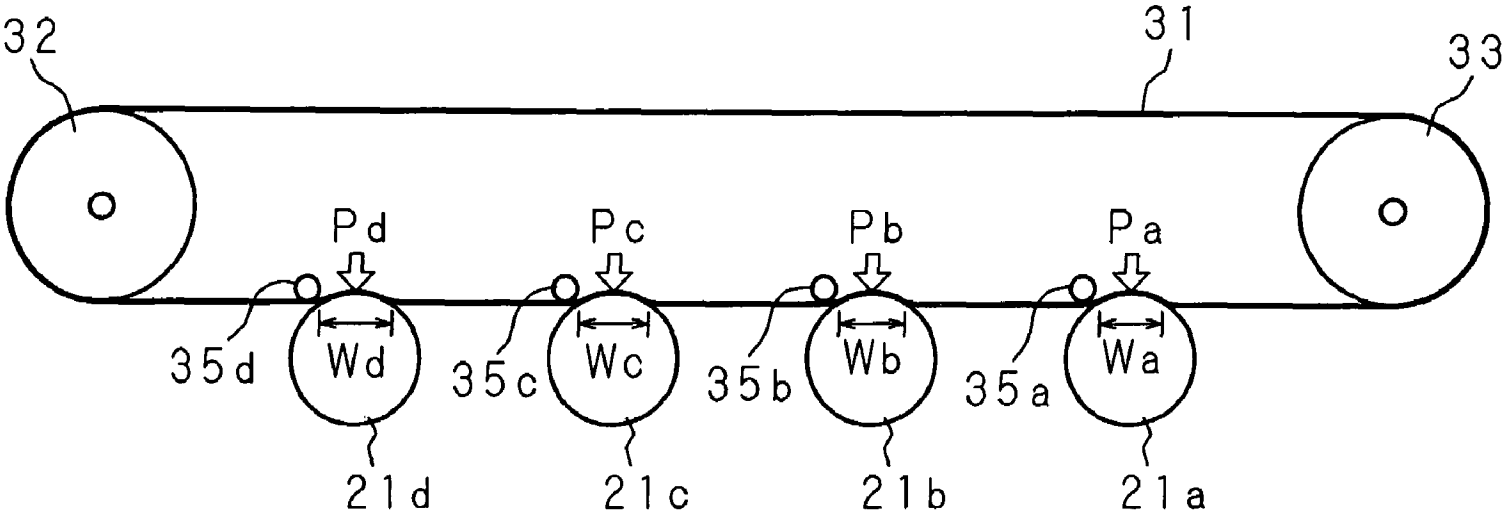
FIG. 9 is a schematic diagram showing a summarization of the installation of the transfer belt units of the image forming apparatus according to the invention.

As understood from the foregoing result of study, each nip width W in the primary transfer process has a lower limit determined by the driving performance of the transfer belt 31 and an upper limit determined by the life of the transfer belt 31, while at the same time making it necessary to widen the nip width W progressively in the order of executing the primary transfer process to obtain the required and sufficient transfer field. The schematic diagram of FIG. 9 summarizes the arrangement of the transfer belt unit 30. The same can be said of the nip pressure P between the each of the photosensitive drums 21*a* through 21*d* and the transfer belt 31. Thus, the nip pressure P has a lower limit determined by the driving performance of the transfer belt 31 and an upper limit determined by the evaluation of the image quality. Specifically, in the case where the contact pressure between the photosensitive drums 21*a* through 21*d* and the transfer belt 31 is excessively low, a stable driving performance of the transfer belt 31 cannot be obtained, while an excessively high contact pressure causes the cohesion of the toner and increases the contact area, thereby making electrostatic transfer difficult at the time in the secondary transfer process for a reduced image quality. The study by the inventors revealed that the lower limit of the nip pressure is 1 g/mm$^2$ and the upper limit thereof is 5 g/mm$^2$ or less. Incidentally, the nip pressure was measured by holding a sheet-like nip pressure sensor between the transfer belt 31 and the photosensitive drum 21 at the position where the intermediate transfer roller 35 and the photosensitive drum 21 are nearest to each other. In the primary transfer process, the toner is sequentially superposed in the primary transfer process, and therefore the cohesion between the toner is increased with the progress of the transfer process. According to this embodiment, in contrast, the cohesion between the toner is prevented by progressively reducing the nip pressure.

Also, according to this embodiment, the nip width and the nip pressure of each transfer nip are adjusted by changing the arrangement of the intermediate transfer roller 35 with respect to the photosensitive drum 21. As an alternative, the nip width and the nip pressure can of course be changed by changing the arrangement of the photosensitive drum 21 with respect to the intermediate transfer roller 35.

Further, according to this embodiment, the intermediate transfer rollers 35*a*, 35*b*, 35*c*, 35*d* are arranged downstream side of the photosensitive drums 21*a*, 21*b*, 21*c*, 21*d*, respectively. As an alternative, the intermediate transfer rollers 35*a*, 35*b*, 35*c*, 35*d* can be arranged upstream side of the photosensitive drums 21*a*, 21*b*, 21*c*, 21*d*, respectively.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A transfer apparatus which comprises a plurality of image forming units for forming an image using developing agent and a transfer belt with which said image forming units are pressed in contact, and forms on said transfer belt a single image by superposing one on another image formed in a primary transfer process by each of said image forming units sequentially transferred to said transfer belt, and transfers the formed image onto a transfer material in a secondary transfer process, while said transfer belt is made to move in a predetermined direction, wherein each of said image forming units is pressed in contact with said transfer belt under a different contact pressure between said transfer belt and each of said image forming units.

2. The transfer apparatus according to claim 1, wherein each of said image forming units is pressed in contact with said transfer belt under the contact pressure progressively lower in the order of transfer of the image to said transfer belt by the image forming units.

3. The transfer apparatus according to claim 2, wherein said contact pressure is not less than 1 $g/mm^2$ but not more than 5 $g/mm^2$.

4. The transfer apparatus according to claim 1, wherein said primary transfer process is a process for applying a voltage to a plurality of conductive rollers pressed in contact with said transfer belt in spaced relation with the contact area between said transfer belt and each of said image forming units.

5. The transfer apparatus according to claim 4, wherein the voltage of the same magnitude is applied to said plurality of the conductive rollers in said primary transfer process.

6. The transfer apparatus according to claim 4, wherein said plurality of the conductive rollers are arranged so as to have substantially the same strength of image transfer to said transfer belt.

7. The transfer apparatus according to claim 1, wherein the resistance value of said transfer belt is not less than $1\times10^8$ Ω but not more than $1\times10^{14}$ Ω.

8. The transfer apparatus according to claim 1, wherein said developing agent is powder toner.

9. A transfer apparatus which comprises a plurality of image forming units for forming an image using developing agent and a transfer belt with which said image forming units are pressed in contact, and forms on said transfer belt a single image by superposing one on another image formed in a primary transfer process by each of said image forming units sequentially transferred to said transfer belt, and transfers the formed image onto a transfer material in a secondary transfer process, while said transfer belt is made to move in a predetermined direction, wherein each of said image forming units is pressed in contact with said transfer belt with a different contact width in said predetermined direction between said transfer belt and each of said image forming units.

10. The transfer apparatus according to claim 9, wherein each of said image forming units is pressed in contact with said transfer belt with the contact width increased progressively in the order of transfer of the image to said transfer belt.

11. The transfer apparatus according to claim 10, wherein said contact width is not less than 3 mm but not more than 10 mm.

12. The transfer apparatus according to claim 9, wherein said primary transfer process is a process for applying a voltage to a plurality of conductive rollers pressed in contact with said transfer belt in spaced relation with the contact area between said transfer belt and each of said image forming units.

13. The transfer apparatus according to claim 12, wherein the voltage of the same magnitude is applied to said plurality of the conductive rollers in said primary transfer process.

14. The transfer apparatus according to claim 12, wherein said plurality of the conductive rollers are arranged so as to have substantially the same strength of image transfer to said transfer belt.

15. The transfer apparatus according to claim 9, wherein the resistance value of said transfer belt is not less than $1\times10^8$ Ω but not more than $1\times10^{14}$ Ω.

16. The transfer apparatus according to claim 9, wherein said developing agent is powder toner.

17. An image forming apparatus comprising:

a communication unit for receiving the image data from an external; and a transfer apparatus which comprises a plurality of image forming units for forming an image using developing agent and a transfer belt with which said image forming units are pressed in contact, and based on the image data received by said communication unit, forms on said transfer belt a single image by superposing one on another image formed in a primary transfer process by each of said image forming units sequentially transferred to said transfer belt, and transfers the formed image onto a transfer material in a secondary transfer process, while said transfer belt is made to move in a predetermined direction, wherein each of said image forming units is pressed in contact with said transfer belt under a different contact pressure between said transfer belt and each of said image forming units.

18. The image forming apparatus according to claim 17, wherein each of said image forming units are pressed in contact with said transfer belt under the contact pressure progressively decreased in the order of image transfer to said transfer belt by said image forming units.

19. An image forming apparatus comprising:

a communication unit for receiving the image data from an external; and a transfer apparatus which comprises a plurality of image forming units for forming an image using developing agent and a transfer belt with which said image forming units are pressed in contact, and based on the image data received by said communication unit, forms on said transfer belt a single image by superposing one on another image formed in a primary transfer process by each of said image forming units sequentially transferred to said transfer belt, and transfers the formed image onto a transfer material in a secondary transfer process, while said transfer belt is made to move in a predetermined direction, wherein each of said image forming units is pressed in contact with said transfer belt with a different contact width in said predetermined direction between said transfer belt and each of said image forming units.

20. The image forming apparatus according to claim 19, wherein each of said image forming units are pressed in contact with said transfer belt with the contact width progressively increased in the order of image transfer to said transfer belt by said image forming units.

* * * * *